US008121321B2

(12) United States Patent
Iwano

(10) Patent No.: US 8,121,321 B2
(45) Date of Patent: Feb. 21, 2012

(54) HEARING AIDS

(75) Inventor: Kenji Iwano, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/726,766

(22) Filed: Mar. 18, 2010

(65) Prior Publication Data

US 2010/0172506 A1 Jul. 8, 2010

Related U.S. Application Data

(63) Continuation of application No. PCT/JP2009/006487, filed on Nov. 30, 2009.

(30) Foreign Application Priority Data

Dec. 26, 2008 (JP) ..... 2008-332569

(51) Int. Cl.
*H04R 25/00* (2006.01)

(52) U.S. Cl. ..... 381/312; 381/23.1; 381/315

(58) Field of Classification Search ..... 381/23.1, 381/91, 92, 312, 313, 314, 315, 320, 321
See application file for complete search history.

(56) References Cited

U.S. PATENT DOCUMENTS

| | | | | |
|---|---|---|---|---|
| 5,434,924 | A | 7/1995 | Jampolsky | |
| 5,991,419 | A * | 11/1999 | Brander | 381/312 |
| 6,549,633 | B1 | 4/2003 | Westermann | |
| 2003/0215106 | A1 | 11/2003 | Hagen et al. | |
| 2008/0089523 | A1 | 4/2008 | Roeck | |
| 2008/0212810 | A1 | 9/2008 | Pedersen | |
| 2008/0273727 | A1 | 11/2008 | Hagen et al. | |
| 2010/0135500 | A1 | 6/2010 | Derleth et al. | |

FOREIGN PATENT DOCUMENTS

| | | |
|---|---|---|
| EP | 1 365 628 A2 | 11/2003 |
| JP | 62-17800 | 1/1987 |
| JP | 5-173592 | 7/1993 |
| JP | 8-44385 | 2/1996 |
| JP | 8-307997 | 11/1996 |
| JP | 9-116999 | 5/1997 |
| JP | 11-262094 | 9/1999 |
| JP | 2004-325284 | 11/2004 |
| JP | 2007-507119 | 3/2007 |
| JP | 2007-336460 | 12/2007 |
| WO | 2007/063139 | 6/2007 |
| WO | 2007/098768 | 9/2007 |

OTHER PUBLICATIONS

International Search Report issued Dec. 22, 2009 in corresponding International Application No. PCT/JP2009/006487.
Written Opinion of the International Searching Authority issued Dec. 22, 2009 in corresponding International Application No. PCT/JP2009/006487.

(Continued)

*Primary Examiner* — Huyen D Le
(74) *Attorney, Agent, or Firm* — Wenderoth, Lind & Ponack, L.L.P.

(57) ABSTRACT

The hearing aids comprise a microphone, a signal processor, and a receiver, and have a constitution in which the microphone generates an input signal from an input sound and generate an output signal and send it to the ear on the opposite side only when a specific condition is satisfied with respect to the input signal at the signal processor, and the receiver reproduces an output sound from the output signal.

12 Claims, 12 Drawing Sheets

OTHER PUBLICATIONS

"Hearing Aids Handbook", Ishiyaku Shuppan, Oct. 15, 2004, first edition, first printing, authored by Harvey Dillon, pp. 413-419 (with English translation).

Supplementary European Search Report issued Oct. 11, 2010 in corresponding European Application No. 09 81 3812.

* cited by examiner

| | 4R | 6 | 5L | 4L | 7 | 5R |
|---|---|---|---|---|---|---|
| A-1 | ○ | ○ | ○ | × | × | × |
| A-2 | × | × | × | ○ | ○ | ○ |
| B-1 | ○ | ○ | ○ | ○ | × | × |
| B-2 | ○ | × | × | ○ | ○ | ○ |
| C | ○ | × | ○ | ○ | × | ○ |
| D | ○ | ○ | ○ | ○ | ○ | ○ |

FIG. 12

HEARING AIDS

This application is a continuation of International Application No. PCT/JP2009/006487, filed Nov. 30, 2009.

TECHNICAL FIELD

The present invention relates to binaural hearing aids that are worn on both ears, the object of which is to provide hearing aids that improve the pickup of sounds on the impaired hearing side where sounds are difficult to hear for a patient with unilateral hearing loss or a patient who has a hearing level difference between the left and right ears, and that reduces annoying noise on the normal hearing side even in noisy environments.

BACKGROUND ART

There is a type of hearing impairment which is normal hearing in one ear, and impaired hearing in the other ear. This is called unilateral hearing loss herein.

With patients suffering from unilateral hearing loss, CROS (contra-lateral routing of signals) hearing aids are used with which a microphone picks up input sound coming from the impaired hearing side, sends it to the hearing aid worn on the normal hearing side, and the sound is reproduced on the normal hearing side. A variation on the CROS hearing aids theme are BICROS hearing aids, with which a microphone is used not only on the impaired hearing side, but also on the normal hearing side, and input sounds from the microphones at both ears are combined and outputted. The BICROS hearing aids are suitable for bilateral hearing loss (see Non Patent Citation 1, for example).

Furthermore, to give a sense of sound source direction and a sense of hearing that is close to that of a normal hearing side to the patient who has a hearing level difference between the left and right ears, there is a technique in which a tiny differential in left and right microphone inputs is decided, and an audio band pass filter is applied to signals obtained by amplifying these two input signals with a differential amplifier (see Patent Citation 1, for example).

Also, in an effort to improve hearing equilibrium between the ears in a deaf patient with a difference in hearing level between the left and right ears, there is a technique in which the hearing level difference and time difference between the left and right ears is measured from an audiogram of a deaf patient, the nonlinear amplification characteristics are varied for each frequency band with respect to the input signal on the normal hearing side, and the time delay is varied for each frequency band, to produce an output signal (see Patent Citation 2, for example).

Further, there is a technique in which signals from both ears are analyzed to estimate the sound source direction, and a sound signal processor suppresses the sound signal in a specific direction or emphasizes it, or a technique in which signals from both ears are analyzed to estimate the amount of masking, and masking is improved (see Patent Citation 3, for example).

PRIOR ART CITATIONS

Non Patent Citations

Non Patent Citation 1: "Hearing Aids Handbook," Ishiyaku Shuppan, Oct. 15, 2004, first edition, first printing, authored by Harvey Dillon, translated by Masafumi Nakagawa, pp. 413-419

Patent Citations

Patent Citation 1: Japanese Laid-Open Patent Application H09-116999

Patent Citation 2: Japanese Laid-Open Patent Application H11-262094

Patent Citation 3: Japanese Laid-Open Patent Application 2007-336460

DISCLOSURE OF INVENTION

With the CROS hearing aids discussed in Non Patent Citation 1, advantages are that speech clarity is enhanced with respect to sounds on the impaired hearing side, and sounds that reach both ears are heard on the normal hearing side, which makes it possible to search for the sound source. On the other hand, a problem is that speech clarity on the normal hearing side is actually diminished in noisy environments.

This is attributed to the fact that CROS hearing aids amplify and output noise from the impaired hearing side on the normal hearing side. As a result, compared with wearing the CROS hearing aid or not, for the patient with the CROS hearing aid, it is difficult to hear the sound on the normal hearing side in a noisy environment. In fact, if a physician prescribed CROS hearing aids to the patients with unilateral hearing loss, some of the patients discontinue using the CROS hearing aids because of this problem.

Furthermore, with the hearing aids discussed in Patent Citation 1, to obtain a sense of direction and a sense of hearing that is close to that of a normal ear when there is a hearing difference between the left and right ears, a technique is disclosed in which two input microphone signals sent to the left and right ears are amplified by a differential amplifier, and an audio band pass filter is applied to these signals. However, the operation here is such that the input signal from the microphone to one ear is treated as output sound by the receiver at the other ear. Accordingly, nothing is disclosed about what kind of sounds on the impaired hearing side are sent to the normal hearing side, or about how they are combined to produce an output sound on the normal hearing side. Also, since this technique is related to analog hearing aids, noise included in the speech frequency band is transmitted straight through, which amplifies the noise and makes it harder to hear in noisy environments where there is no speech. Thus, nothing at all is either disclosed or implied regarding the problem which the present invention is intended to solve.

With the hearing aids discussed in Patent Citation 2, a technique is disclosed in which the interaural level difference and interaural time difference are adjusted in the auditory system of the left and right ears. The operation here is such that the input signal from the microphone at one ear is used as the output sound by the receiver at the other ear. However, nothing is disclosed about what kind of sounds on the impaired hearing side are sent to the normal hearing side, or about how they are combined to produce an output sound on the normal hearing side. Also, gain adjustment is performed on the basis of the hearing level measured with an audiometer, but the nonlinear amplification characteristics on the normal hearing side are determined according to the hearing level on the impaired hearing side. Accordingly, nothing at all is either disclosed or implied regarding the problem of difficulty in hearing in noisy environments, which is what the present invention is intended to solve.

Patent Citation 3 discloses a technique in which the sound source direction is estimated using input signals from microphones at the left and right ears. The technique disclosed here involves linking the left and right input signals for speech signal processing, but nothing is disclosed about the problem of dealing with patients having hearing level difference between the left and right ears that is what the present invention is intended to solve, or about how to solve such a problem. Furthermore, nothing at all is either disclosed or implied regarding the problem of difficulty in hearing in noisy environments.

The present invention was considered to solve the above-mentioned problems encountered in the past, and it is an object thereof to provide hearing aids with which a patient with unilateral hearing loss or with a hearing level difference between the left and right ears will be better able to hear sounds on the impaired hearing side and the normal hearing side, and will be able to hear well even in noisy environments.

Technical Solution

The hearing aids of the present invention are a pair of hearing aids worn on the left and right ears respectively, comprising a first hearing aid and a second hearing aid. The first hearing aid has a first microphone, a transmission determination component, and a transmission component. The first microphone generates a first input signal. The transmission determination component decides whether or not the first input signal satisfies a specific condition. The transmission component transmits the first input signal when the transmission determination component has decided that the first input signal satisfies a specific condition. The second hearing aid has a reception component, a hearing aid signal processor, and a receiver. The reception component receives the first input signal sent from the transmission component. The hearing aid signal processor generates an output signal on the basis of the first input signal received by the reception component. The receiver reproduces an output sound on the basis of the output signal received from the hearing aid signal processor.

With this constitution, it is possible to provide hearing aids that link both ears so that it is easier to hear even in noisy environments, for patients having unilateral hearing loss or a hearing level difference between the left and right ears.

Also, with the hearing aids of the present invention, the transmission determination component sends the first input signal to the reception component when it has been decided that the first input signal includes a speech interval.

With this constitution, noise from the impaired hearing side will not be sent to the normal hearing side under a noisy environment, which improves speech clarity on the normal hearing side.

Also, with the hearing aids of the present invention, the transmission determination component sends the first input signal to the reception component when it has been decided that the signal strength of the first input signal is less than the signal strength that can be heard at the hearing level of the hearing aids wearer.

With this constitution, only sounds that cannot be heard on the impaired hearing side according to the hearing level of the wearer of the hearing aids are sent to the normal hearing side. This makes it easier to hear on the normal hearing side.

Also, with the hearing aids of the present invention, the transmission determination component sends the first input signal to the reception component when it has been decided that the signal strength of the first input signal is less than the minimum audible value for each frequency band on the impaired hearing side of the hearing aids wearer.

With this constitution, because the minimum audible value for each frequency band is used as the hearing level, the hearing aids can be tailored to the hearing level of the wearer. Thus, sounds that cannot be heard on the impaired hearing side can be accurately detected, so only the minimum required signals are sent to the normal hearing side, which makes it easier to hear on the normal hearing side.

Also, with the hearing aids of the present invention, the first input signal is divided into a plurality of segments at specific times. The hearing aid signal processor performs the same smoothing processing on the first input signal in at least two of the plurality of segments.

With this constitution, unnatural noise can be suppressed at the timing at which the signals sent from the impaired hearing side to the normal hearing side switch from a sound interval to a silent interval, or from a silent interval to a sound interval. This makes it easier to hear on the normal hearing side.

Also, with the hearing aids of the present invention, the transmission determination component sends the first input signal to the reception component when it has been decided that the first input signal is not within a noise interval.

With this constitution, a sound that the hearing aids wearer wants to hear that is outside of the speech interval on the impaired hearing side, such as music, is sent to the impaired hearing side, which makes wearing the hearing aids more enjoyable.

Also, with the hearing aids of the present invention, the second hearing aid further has a second microphone that generates a second input signal. The hearing aid signal processor generates an output signal on the basis of a third input signal generated by combining the first input signal and the second input signal at a specific combination ratio.

With this constitution, the present invention can be applied to those patients who would benefit from wearing a hearing aid on the normal hearing side, out of all patients who have unilateral hearing loss or have a hearing level difference between the left and right ears. This makes it easier for a patient with hearing impairment to hear.

Also, with the hearing aids of the present invention, the second input signal has a predetermined time delay.

With this constitution, even if a delay is generated by communication from the impaired hearing side to the normal hearing side, the signals from the left and right ears can be phase matched on the time axis. This improves performance in the case of directional combination processing during subsequent hearing aid signal processing, for example.

Also, with the hearing aids of the present invention, the specific combination ratio is determined on the basis of the hearing level difference between the right and left ears of the hearing aids wearer.

With this constitution, an output signal corresponding to the hearing level of the patient can be produced. This makes it easier to hear on the normal hearing side.

Also, with the hearing aids of the present invention, the first hearing aid is worn on the hearing impaired ear with the lower hearing level out of the right and left ears of the hearing aids wearer. The second hearing aid further has a second microphone that generates a second input signal. The hearing aid signal processor generates a third input signal from the first input signal and the second input signal on the basis of the relation between the direction of the hearing impaired ear and the sound source direction estimated from the first input signal and the second input signal, and generates the output signal on the basis of the third input signal.

With this constitution, linking between the two ears is controlled according to the sound source direction, which makes it easier to hear in directions in which the wearer has trouble hearing.

Also, with the hearing aids of the present invention, the hearing aid signal processor generates the third input signal by combining the first input signal and the second input signal in a ratio determined on the basis of the relation between the direction of the hearing impaired ear and the sound source direction.

With this constitution, there is no transmission when the sound source direction is on the normal hearing side, and there is only transmission when the sound source direction is on the normal hearing side, which makes it easier to hear on the normal hearing side. Furthermore, the combination ratio is varied according to the angle of the sound source direction from the straight ahead direction, so there are no sudden changes in the amplification of the output signal even though the sound source direction moves, etc. Thus, a smoother output sound makes wearing the hearing aids more enjoyable.

Also, with the hearing aids of the present invention, at least one of the first microphone, the second microphone, and the receiver can be set to be non-operational.

With this constitution, the power supply is controlled to change the setting between operational and non-operational. Thus, power is supplied only to the minimum required number of elements, and is not supplied to any unnecessary constituent elements. As a result, power consumption is reduced, and the operational time when a battery is used as the power supply can be extended.

Advantageous Effects

The present invention provides hearing aids with which a deaf patient having unilateral hearing loss or having a hearing level difference between the left and right ears will be better able to hear sounds on the impaired hearing side and the normal hearing side, and it will be easier to hear even in noisy environments.

BRIEF DESCRIPTION OF DRAWINGS

FIG. 12 is an example of setting with a configuration setting component of the hearing aids pertaining to the fifth embodiment of the present invention.

BEST MODE FOR CARRYING OUT THE INVENTION

The hearing aids pertaining to an embodiment of the present invention will now be described through reference to the drawings.

Embodiment 1

Figure 1:
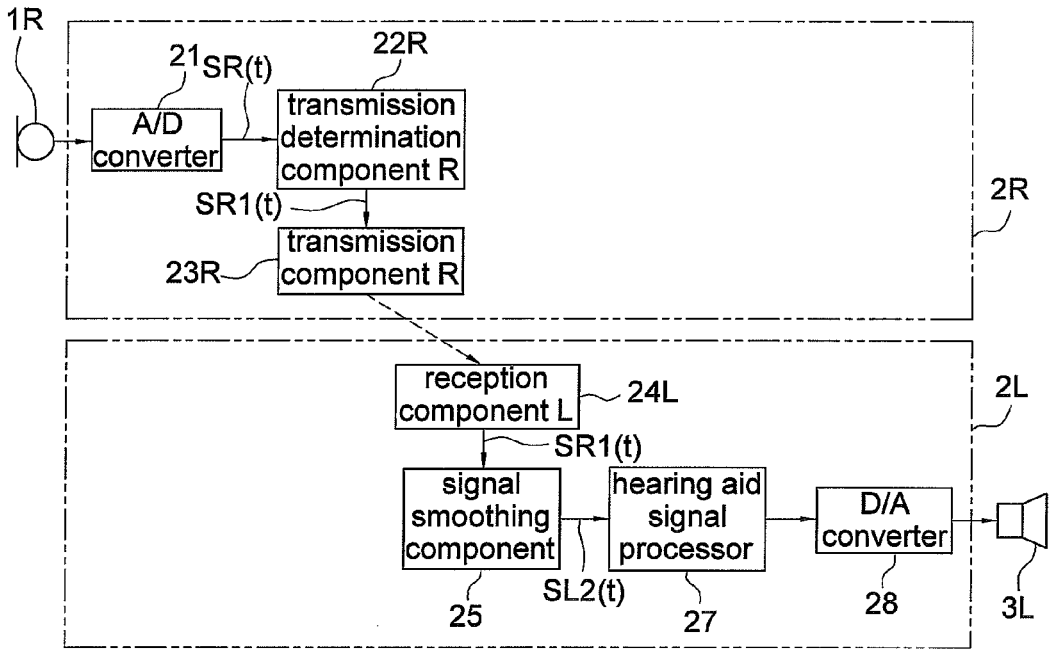
FIG. 1 is a diagram of the hearing aids pertaining to a first embodiment of the present invention.

FIG. 1 is a diagram of the hearing aids pertaining to a first embodiment of the present invention.

The hearing aids of the present invention can be broadly divided into four constituent elements: a right ear microphone (first microphone) 1R, a right ear signal processor (first hearing aid) 2R, a left ear signal processor (second hearing aid) 2L, and a left ear receiver 3L.

In FIG. 1, those constituent elements worn on the right ear side have an "R" at the end of the name, while those worn on the left ear side have an "L." For example, the microphone worn on the right ear side is referred to as the "microphone 1R." Furthermore, FIG. 1 illustrates an example of applying the present invention to hearing aids worn by a patient with which the impaired hearing side is the right side, and the normal hearing side is the left side. However, the present invention can of course be applied to hearing aids worn by a patient with which the normal hearing side and impaired hearing side are reversed.

Next, the flow of processing in the various constituent elements will be described.

First, the microphone 1R converts an input sound into an electrical signal. Then, the right ear signal processor 2R determines whether or not to transmit on the basis of a specific condition with respect to the input signal. If the specific condition here is satisfied, an electrical signal is sent to the left ear signal processor 2L. The right ear signal processor 2R generates an output signal by adding a acoustic signal processing to the received signal. The receiver 3R converts an electrical output signal into an output sound, which is conveyed to the hearing aids wearer as sound. The above-mentioned specific condition that serves as the condition for determining whether or not to transmit will be discussed in detail below.

Next, the flow of processing in the right ear signal processor 2R will be described in detail.

First, an A/D converter 21 converts an analog input signal picked up by the microphone 1R into a digital input signal SR(t). A transmission determination component 22R then determines whether or not to sent the input signal SR(t) from the right ear side to the left ear side through a communication path.

We will let the signal sent from the right ear side to the left ear side here be SR1($t$). The transmission determination component 22R outputs the signal SR1($t$) that will be the input of a transmission component 23R on the basis of this determination result. The transmission component 23R then sends this transmission signal SR1($t$) from the right ear hearing aid to the left hearing aid.

From this point we will switch to the left ear hearing aid and describe the flow of processing.

A left ear reception component 24L receives the signal SR1($t$) sent from the right ear side.

Next, a signal smoothing component 25L performs smoothing on the signal SR1($t$) at the timing at which the signal SR1($t$) changes from silence to sound, and at the timing at which the change is from sound to silence, and generates a signal SL2($t$). The reason for this processing is that sound with a high acoustic pressure level are included in the sound interval at the timing at which there is a change from silence to sound, the hearing aids wearer will be startled by the difference in the acoustic pressure level, which can be unpleasant. That is, when sound with a large difference in acoustic pressure level is included, the acoustic pressure level is changed gradually over time between a silent interval and a sound interval.

The acoustic pressure level fluctuation time here at the timing at which there is a change from the silent interval to the sound interval is expressed as the attack time, and the acoustic pressure level fluctuation time at the timing at which there is a change from the sound interval to the silent interval is expressed as the release time. When the input signal is speech, the attack time is preferably set to a short time, and the front portion of the speech outputted by the receiver as much as possible. On the other hand, the release time is preferably set to a long time, so that tracking is better when speech is resumed after first being cut off.

A hearing aid signal processor 27 performs acoustic signal processing in the hearing aids using this signal SR1(*t*) as input. Examples of the acoustic signal processing performed by the hearing aid signal processor 27 include directional combination processing in which sound in a specific direction is emphasized or suppressed, noise suppression processing in which constant or non-constant noise is suppressed, nonlinear compression amplification processing in which the amplification rate is varied for each frequency signal according to the shape of the audiogram of the hearing aids wearer, howling suppression processing in which howling, which tends to occur when hearing aids are worn, is suppressed, and so forth, although this list is not meant to be comprehensive.

Signal processing that makes hearing easier even in noisy environments can be applied by using SS (spectral subtraction) or a Wiener filter as the noise suppression function.

If the hearing is extremely good on the normal hearing side, it is also conceivable that the input signal and output signal will be equivalent if the hearing aid signal processor 27 sets the signal processing to pass-through.

A D/A converter 28 converts the digital output signal of the hearing aid signal processor 27 into an analog output signal. The receiver 3L generates an output sound on the basis of the analog output signal of the signal processor 2L.

Let us now consider what kind of output is preferable for deafness involving unilateral hearing loss or a hearing level difference between the left and right ears.

Any patient will have a good hearing ear and a hearing impaired ear, and if the hearing level on the impaired hearing side can be improved by wearing a hearing aid, there are cases in which the problem is solved merely by wearing a hearing aid on the impaired hearing side.

On the other hand, with severe hearing impairment with which an improvement in the hearing level on the impaired hearing side is difficult to achieve just by wearing a hearing aid, some other approach must be taken. One of these is to use CROS hearing aids that make use of auditory nerves on the good hearing ear side.

As discussed above, however, a problem with CROS hearing aids is that it is difficult to hear in noisy environments. This is because in a noisy environment the microphone on the impaired hearing side picks up noise, and that noise is amplified in the generation of an output sound on the normal hearing side.

One of the things that is most problematic with unilateral hearing loss is the possibility of a decrease in speech communication capability on the part of the hearing impaired person. A particular problem is that it can be difficult to catch speech in a noisy environment.

To solve this problem, the input signal on the impaired hearing side is subjected to speech detection processing, and only the time interval detected as a speech interval is sent from the impaired hearing side to the normal hearing side. This allows the wearer to catch speech on the impaired hearing side.

The speech interval here is defined as a time interval in which a speech signal is included in speech detection processing. If there is a non-speech interval that cannot be determined to be a speech interval, this can be concluded to be a noise interval. Specifically, even in noisy environments, the noise component included in a non-speech interval will not be sent to the impaired hearing side. That is, only speech on the impaired hearing side is sent to the normal hearing side, which makes it possible to provide hearing aids with which the hearing aids wearer can hear more easily in noisy environments.

FIG. 1 here shows application to a hearing impaired person with a hearing level difference between the left and right ears, and in particular to a case in which the hearing level is good on the normal hearing side, and there is no need to wear a hearing aid on the normal hearing side.

Figure 2:
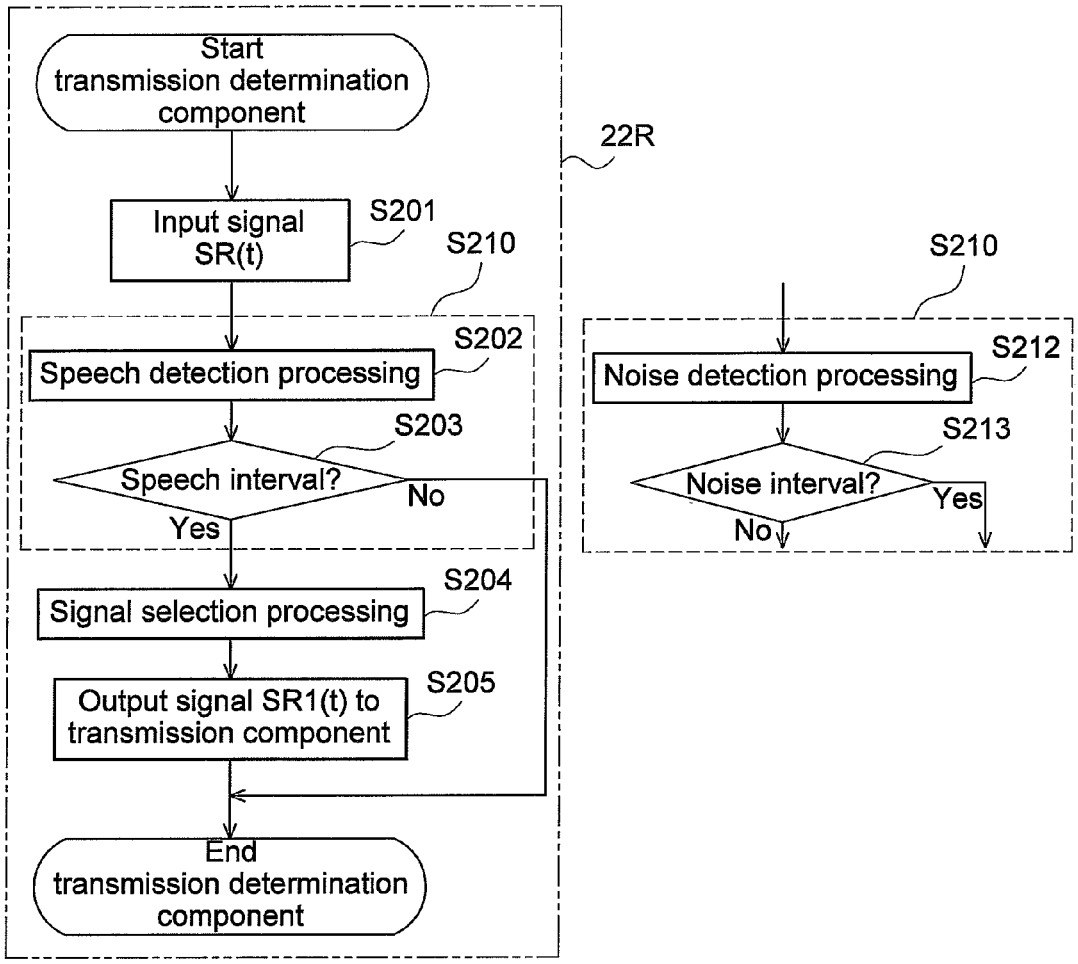
FIG. 2 is a flowchart of the transmission determination component of the hearing aids pertaining to a first embodiment of the present invention.

FIG. 2 is a flowchart of the transmission determination component of the hearing aids in Embodiment 1, and the flow of processing with the transmission determination component 22R on the right ear side will now be described.

First, the input signal SR(t) is inputted at the transmission determination component 22R, the input signal SR(t) is divided into specific time segments, and speech detection processing is performed. There is a method in which MFCC (Mel Frequency Cepstral Coefficients) are used as a feature amount for performing speech detection, and a method in which the signal strength in the speech frequency band is used as a feature amount for reducing the amount of computation. A known method is applied for the speech detection method itself (S202).

Also, a "speech detection method in which a vowel interval is detected within an input sound, the ratio of the detected vowel interval length to the input sound interval length is found, and it is determined that the input sound is speech when this ratio is above a threshold value," which is in the description of the Speech Interval Determination Method of Japanese Laid-Open Patent Application S62-17800, can be applied, for example, as a known speech detection method.

Also, a "speech/non-speech determination method in which a plurality of speech feature amounts are selected at specific times from an input signal using a primary autocorrelation function and/or a secondary or higher autocorrelation function that characterizes speech, to determine whether or not the signal is speech," which is in the description of the Speech/Non-Speech Determination Method and Determination Apparatus of Japanese Laid-Open Patent Application H5-173592, can be applied, for example, as a known speech detection method. Specifically, speech detection involves detecting whether an interval to be processed is a speech interval or a non-speech interval, or is an unspecified interval for which it is not clear whether it is speech or non-speech, with respect to a signal of a specific time period.

When this detection processing determines the input signal SR(t) to be a speech interval, the signal for that interval is selected, and this is newly termed signal SR1(*t*). The signal SR1(*t*) is outputted to the transmission component 23R for the purpose of transmission to the left hearing aid (S205).

On the other hand, when this detection processing determines the input signal SR(t) not to be a speech interval, there is not output to the transmission component 23R.

The above concludes the processing at the transmission determination component 22R, and if a specific time period has elapsed, the processing shown in FIG. 2 is performed again.

Performing speech detection processing is not the only method for performing transmission determination here, and noise detection processing can also be performed.

In FIG. 2, noise detection processing (S212) and noise interval determination (S213) can also be performed in a portion of S210. The reason for performing this noise detection processing is that if noise detection processing is performed and everything other than a noise detection interval is transmitted, then it will also be possible to transmit desired signals other than speech (such as music).

A known method can be applied as the noise detection method. Further, a known method can be used for noise detection processing.

A "method for storing specific time power values in time series, calculating a threshold for determining a noise interval from the specific time power values, and determining that an input signal having a specific time power value not exceeding said threshold is a noise interval," which is in the description of the noise interval detection apparatus of Japanese Laid-Open Patent Application H8-44385, can be applied, for example, as known noise detection processing.

The description of FIG. 1 is an example of a digital hearing aid, but the present invention can also be applied to an analog hearing aid that handles input signals as analog signals.

Also, the communication path from the right ear side to the left ear side, and from the left ear side to the right ear side, may be either a wireless or wired communication path. The reliability of the communication path can be enhanced by applying communication path error detection processing, error correction processing, and retransmission processing or other such communication path encoding.

Also, the description of FIG. 1 was such that the transmission determination component 22R included the right ear signal processor 2R, but in another possible constitution, the transmission determination component 22R is removed from the left ear signal processor 2L, and as a replacement a transmission determination component is disposed between the reception component 24L and the signal smoothing component 25L in the left ear signal processor 2L.

Specifically, if the communication path between the transmission component 23R and the reception component 24L is wireless, the configuration in FIG. 1 is preferable because it cuts down on power consumption, but if the communication path is wired, there are other options besides the configuration shown in FIG. 1.

Some hearing aids that have a directional combination function have two or more microphones in the hearing aid on one side of the head. In this case, the present invention can be similarly applied by having a configuration in which there are two microphones 1R, two A/D converters 21, two transmission determination components 22R, two transmission components 23R, two reception components 24L, and two signal smoothing components 25L.

Figure 3:
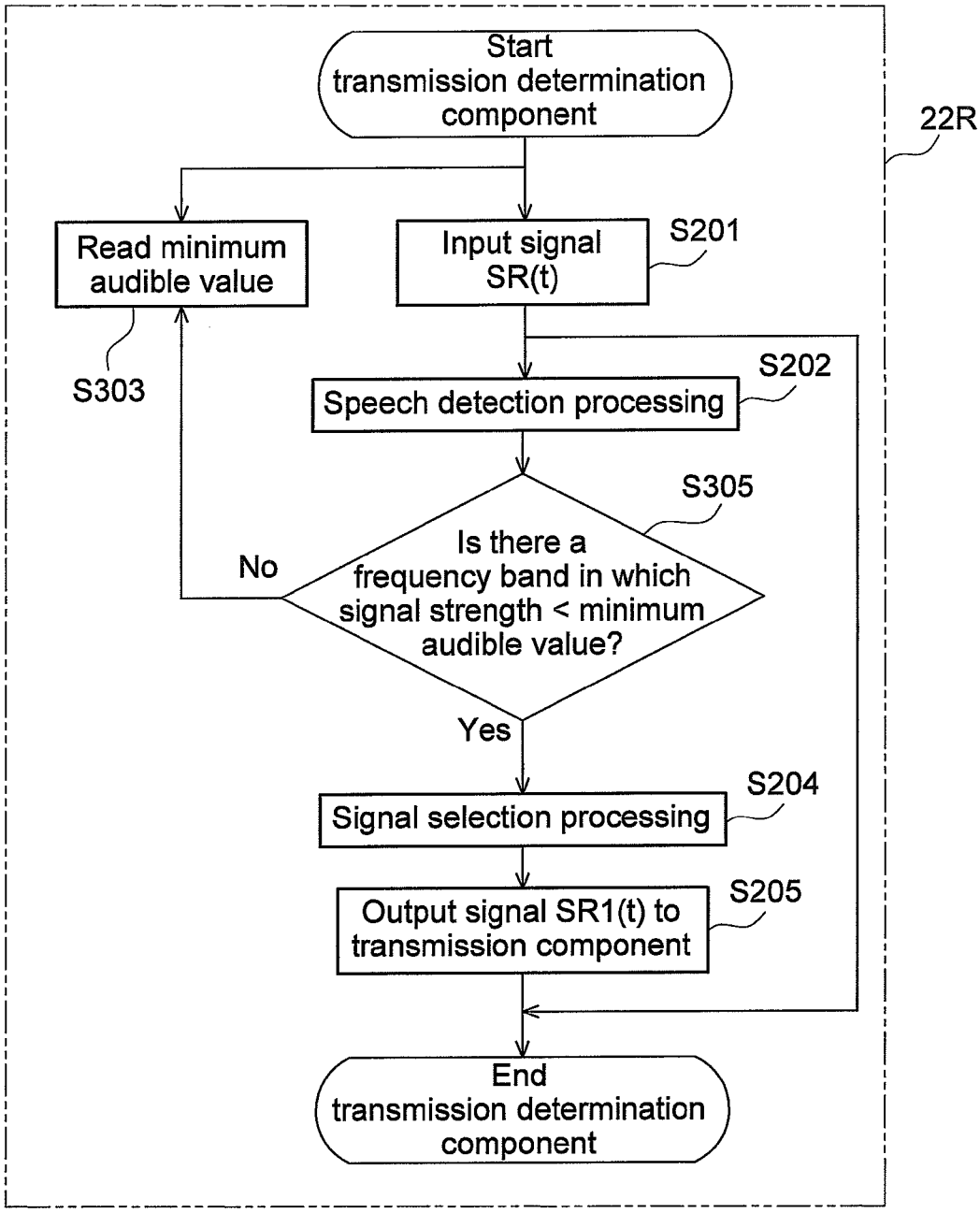
FIG. 3 is a flowchart pertaining to a transmission determination component based on the hearing level of the hearing aids pertaining to a first embodiment of the present invention.

FIG. 3 is a flowchart of the transmission determination component in the hearing aids of Embodiment 1. We will now describe the flow of processing in the transmission determination component 22R on the right ear side.

FIG. 3 illustrates the same constituent elements as in FIG. 2, but whereas FIG. 2 showed the processing flow of making a determination based solely on whether or not there is a speech signal, FIG. 3 differs in that the determination is made by referring both to whether or not there is a speech signal and to the hearing level of the hearing aids wearer. In FIG. 3, those portions of constituent elements that are the same as in FIG. 2 (such as processing (S201)) will not be described again.

First, the hearing level of the hearing aids wearer is measured, and the hearing level on the impaired hearing side where the microphone is worn is read (S303). The minimum audible value measured from an audiogram is used here as an example, but other methods can be used instead, such as using the average hearing level or the MCL (most comfortable level).

Speech processing is then performed on an input signal SR(t) (S305), and the signal strength in an interval determined to be a speech detection interval is calculated on the basis of the speech detection processing result. This signal strength is compared to the minimum audible value, and if the signal strength is less than the minimum audible value, the interval is determined to be a transmission interval (S305).

In this processing, only speech signals that are impossible to hear on the impaired hearing side are detected and sent to the normal hearing side. Speech that can be heard on the impaired hearing side is not transmitted, and this allows transmission to the normal hearing side to be kept to the required minimum. Thus, the comfort of the hearing aids wearer is enhanced.

It is also possible for the minimum audible value for each frequency band measured with an audiogram to be applied as the hearing level. In this case, it is conceivable that the signal strength for each frequency band will be compared to the minimum audible value by subjecting the input signal to frequency analysis processing (such as FFT, sub-band coding, or the like). This affords greater flexibility to accommodate hearing impaired patients whose hearing level frequency characteristics vary sharply.

The determination method employed by the transmission determination component in this case can be the same as discussed above, in which the minimum audible value is compared to the signal strength for each frequency band, and it is determined whether or not there is an interval less than the minimum audible value in at least one frequency band of the signal strength.

Embodiment 2

Figure 4:
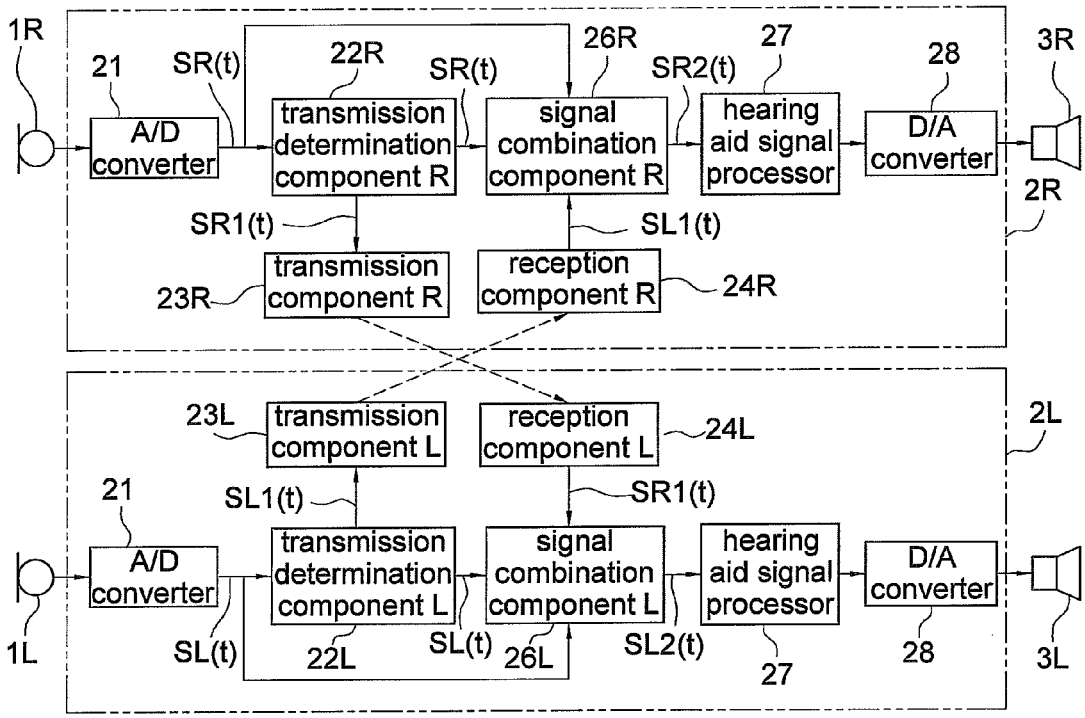
FIG. 4 is a diagram of signal combination in the hearing aids pertaining to a second embodiment of the present invention.

FIG. 4 is a diagram of signal combination in the hearing aids pertaining to a second embodiment of the present invention.

FIG. 4 is similar to FIG. 1 in that it is an example of application to unilateral hearing loss and to deafness in which there is a hearing level difference between the left and right ears. In particular, FIG. 4 is an example of a configuration applied to hearing aids in which the hearing level is diminished on both the normal hearing side and the impaired hearing side, and which is worn by a patient who is preferred to be worn a hearing aids on both the normal hearing side and the impaired hearing side.

First, the differences between FIGS. 4 and 1 will be described.

The configuration in FIG. 1 is an example of application to a patient with unilateral hearing loss and who does not need to wear a hearing aid on the normal hearing side, but if a hearing aid also needs to be worn on the normal hearing side, there is a method in which a microphone is installed at both the left and right ears, the right ear input signal and the left ear input signal are combined into one signal, and an output sound is reproduced with respect to the normal hearing side. In FIG. 4, microphones (microphones 1L and 1R) are provided on both the left and right ear sides. Portions that are the same in FIGS. 1 and 4 will not be described again.

First, the flow of processing in the various constituent elements will be described.

The first thing is that the microphone 1R converts an input sound into an electrical signal. Then the right ear signal processor 2R determines whether or not the input signal can be transmitted, and transmits to the left ear signal processor 2L on the basis of this determination result. Meanwhile, on the left ear side, a microphone (second microphone) 1L converts an input sound into an electrical signal and sends it to the left ear signal processor 2L. The left ear signal processor 2L generates a combined signal by combining the received right ear signal and left ear signal, and subjects this signal to acoustic signal processing to generate an output signal. The receiver 3R then converts the electrical output signal into an output sound, which is conveyed to the hearing aids wearer as sound.

The flow of processing in the transmission determination component 22R on the right ear side is the same as in FIGS. 2 and 3, and so will not be described again.

A difference between the constituent elements in FIGS. 1 and 4 is that signal combination components 26 are provided in FIG. 4. The flow of processing in the signal combination component 26L will be described through reference to FIG. 5.

Figure 5:
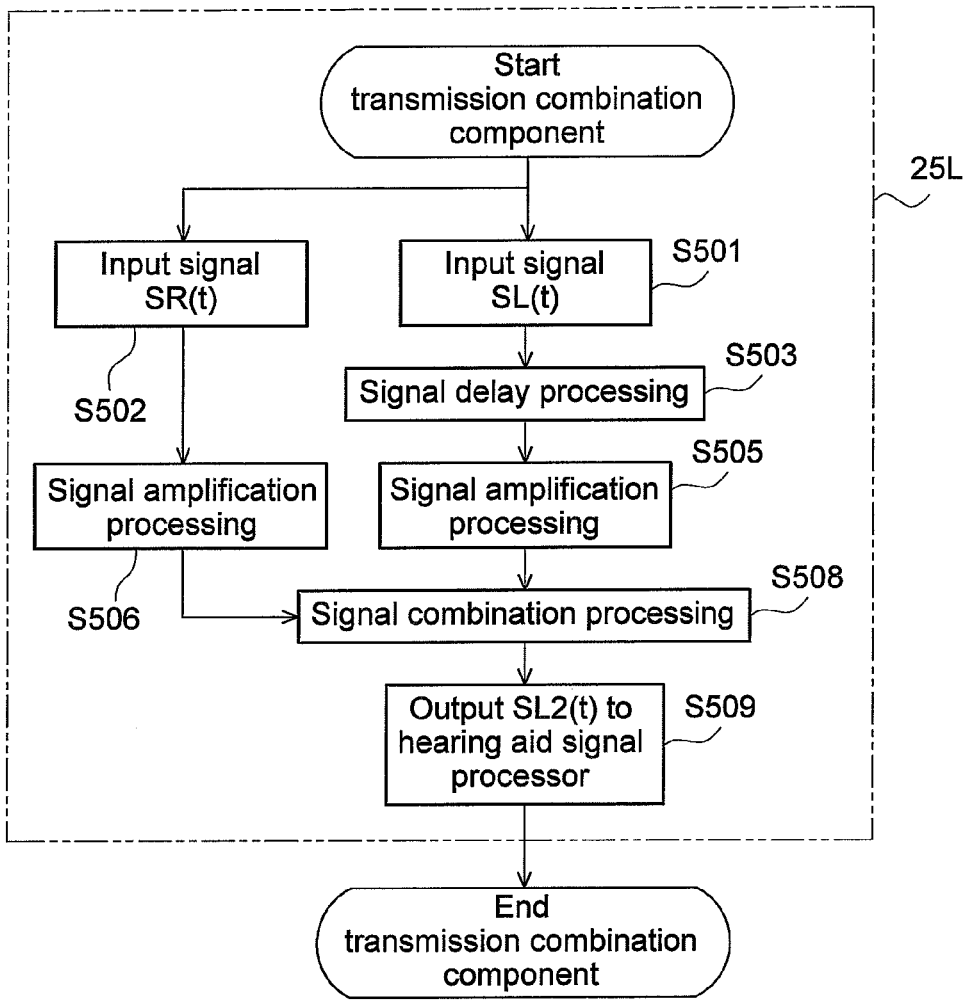
FIG. 5 is a flowchart of the signal combination component of the hearing aids pertaining to a second embodiment of the present invention.

FIG. 5 is a flowchart of the signal combination component 26L of the hearing aids pertaining to Embodiment 2. The flow of processing in the signal combination component 26L on the left ear side will be described here.

First, a signal SL(t) picked up by the left ear microphone is inputted (S501). A signal SR1(*t*) picked up by the right ear microphone is also inputted. A time delay is then applied to SL(t) in order to combine SL(t) and SR1(*t*) (S503).

The reason for providing a time delay is that transmission and reception processing creates a time delay in the signal SR1(*t*) from the right ear as compared to the actual time, so the times (or phases) of the signals on the left and right ear sides must be matched. The amount of delay can be decided by the time it takes for transmission and reception processing, that is, by the frame length (time length) of performing communication path coding processing, decoding processing, communication processing, and so forth.

Next, the right ear signal SR1(*t*) is subjected to signal amplification and compression processing (S504), and the left ear signal SL(t) is subjected to amplification and compression processing (S505).

The reason here for performing signal amplification and compression processing is to change the signal combination ratio according to the hearing level difference between the left and right ears. For example, if we let k be the amplification ratio on the left ear side ($0 \leqq k \leqq 1$), the combination ratio can be changed by setting the amplification ratio on the right ear side to $1-k$. Signal amplification and compression processing can also be performed for each frequency band.

Here, the hearing level of the patient can be measured in advance, the combination ratio of the amplification ratio for signal amplification and compression processing can be decided on the basis of the hearing level difference between the left and right ears of the patient. Also, if there is a minimum audible value for each frequency band for the patient, then the combination ratio can be decided on the basis of the difference between the left and right minimum audible values for each frequency band.

Next, the right ear signal SR1(*t*) and the left ear signal SL(t) are combined to produce SL2(*t*) (S506). This signal SL2(*t*) is then outputted to a hearing aid signal processor (S509). The processing in the signal combination component 26L is ended here, and the above-mentioned processing is repeated at specific time intervals.

In the above description, a constitution in which a receiver was disposed only on the normal hearing side was given as an example, but with the constitution in FIG. 4, a receiver is provided not only on the left ear side, but also on the right ear side, taking into account application to a patient with unilateral hearing loss, with whom wearing hearing aids on both the left and the right is suitable. This affords constituent elements that can flexibly adapt to the hearing level of a patient.

Embodiment 3

Figure 6:
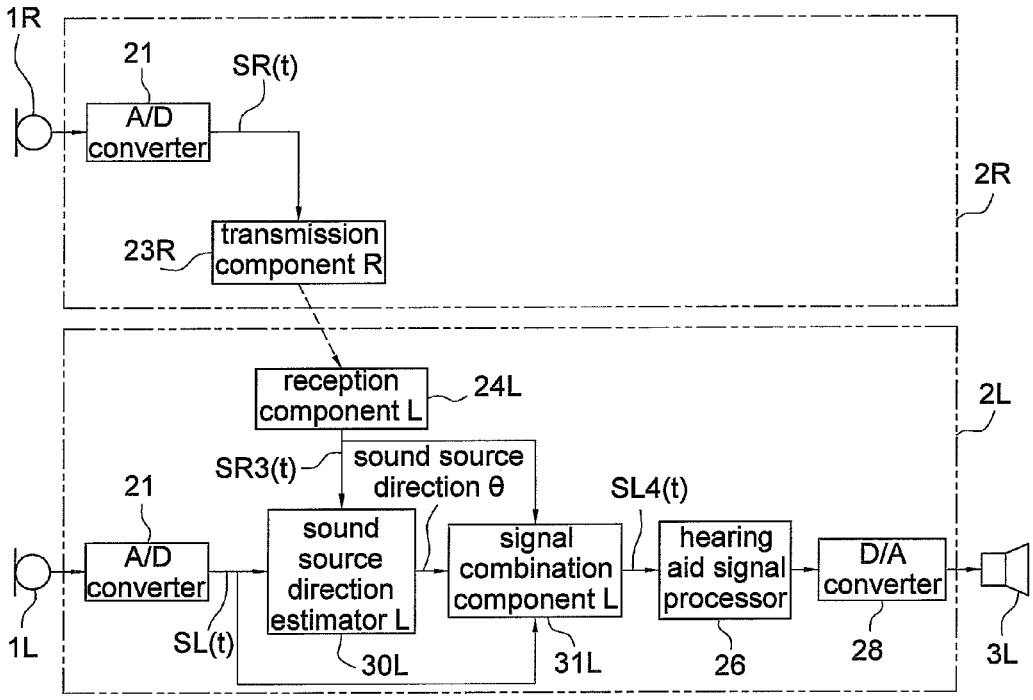
FIG. 6 is a diagram of the hearing aids pertaining to a third embodiment of the present invention.

FIG. 6 shows the constitution of the hearing aids of a third embodiment pertaining to the present invention.

First, the differences between FIG. 1 and FIG. 6 will be described.

In FIG. 1, a determination is made on the basis of whether or not there is a speech interval in order to determine whether to send a signal from the impaired hearing side to the normal hearing side. In contrast, in FIG. 6, the sound source direction is estimated, and a determination is made on the basis of whether or not the sound source direction is on the impaired hearing side. In FIG. 6, an example is given of applying the present invention to a patient whose impaired hearing side is the right ear side and whose normal hearing side is the left ear side, but of course the same applies to when the normal hearing side and impaired hearing side are reversed.

The flow of processing will now be described through reference to FIG. 6, but those constituent elements that are the same in FIGS. 1 and 6 will not be described again.

Input sounds are converted into input signals by the right ear microphone 1R and the left ear microphone 1L. A digital input signal is then produced by the A/D converter 21.

A transmission determination component 22R is present as a constituent element in FIG. 1. In FIG. 6, on the other hand, a difference from FIG. 1 is that the transmission determination component 22R of FIG. 1 is not present since all of the input signals SR(t) are transmitted. The reason for sending all of the input signals SR(t) is to estimate the sound source direction on the entire time axis in order to estimate the sound source direction. If a target sound is only a speech signal, the amount of communication data can be reduced by providing the transmission determination component 22R just as in FIG. 1.

The flow of processing in the transmission component 23R and the reception component 24L is the same as in FIG. 1, and so will not be described again, but the input signal on the right ear side, which is the output of the reception component 24L, will be designated the input signal SR3(*t*). SR3(*t*) is a signal that has been time-delayed for communication processing, so it is used apart from SR(t).

Next, in a sound source direction estimator 30L, the sound source direction of the target sound is estimated using the input signal SR3(*t*) from the right ear side and the input signal SL(t) from the left ear side, and the estimated sound source direction θ is outputted.

A signal combination component 31L then combines SR3(*t*) and SL(t), which are the input signals from the left and right ears, on the basis of the sound source direction θ to produce a signal SL4(*t*). The signal combination component 26L was present in FIG. 4, and the difference between the signal combination component 26L in FIG. 4 and the signal combination component 31L in FIG. 6 is the inclusion of the sound source direction θ as an input signal.

Figure 7:
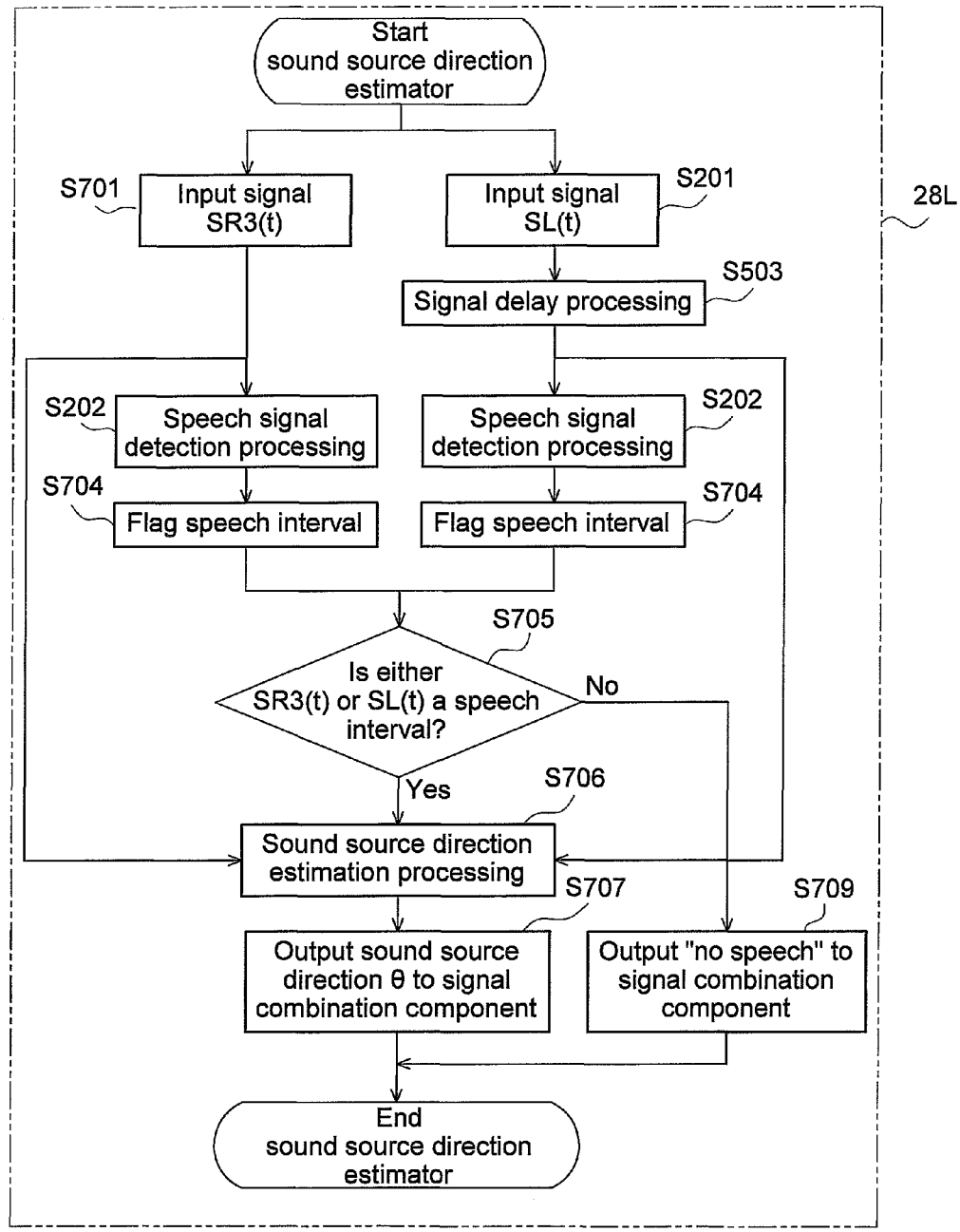
FIG. 7 is a flowchart of a sound source direction estimator of the hearing aids pertaining to a third embodiment of the present invention.

Next, the flow of processing in the sound source direction estimator 30L in FIG. 6 will be described through reference to FIG. 7.

First, the right ear signal SR3(*t*) is inputted (S701), and the left ear signal SL(t) is inputted (S201). Then, the signal SL(t) is subjected to delay processing (S503) to correct the time delay generated by communication processing from the right ear side to the left ear side. The right ear signal and left ear signal are then both subjected to speech detection processing (S202). This speech detection processing is the same as described above, and so will not be described again.

Next, a speech interval flag is attached to a signal including a speech interval, for both the right ear signal and the left ear signal (S704). It is then determined whether or not the right ear signal SR3(*t*) and the left ear signal SL(t) are signals that include a speech interval. If the result of this determination is that either one has been flagged for a speech interval, the flow moves to step S706. On the other hand, if neither signal been flagged for a speech interval, they are considered to be signals that include a silence interval, and the flow moves to step S706 (S705).

In the example given here, there was a switch to sound source direction estimation processing depending on an OR condition for speech interval flagging of the two signals, but the switch to sound source direction estimation processing may instead be performed by an AND condition for speech interval flagging of the two signals, by a difference in speech detection methods, or by a difference in usage scenarios.

If it is determined that one of the signals has been flagged for a speech interval, the sound source direction is estimated for the speech signal included in that signal, and the sound source direction θ is outputted (S506).

The sound source direction estimation processing can be performed by using, for example, the "sound source separation system comprising (1) means for inputting the acoustic signals generated from a plurality of sound sources from left and right sound receiving components; (2) means for dividing the left and right input signals by frequency band; (3) means for finding the IPD for each frequency band from a cross spectrum of the left and right input signals, and the ILD from the level difference of a power spectrum; (4) means for estimating potential sound source directions for each frequency band by comparing the IPD and/or the ILD with that of a database in all frequency bands; (5) means for estimating that the direction having the highest frequency of occurrence to be the sound source direction from among the sound source directions obtained for each frequency band; and (6) means for separating the sound sources by extracting mainly the frequency band of the specific sound source direction based on information about the estimated sound source direction" described in Japanese Laid-Open Patent Application 2004-325284.

If there is a speech interval flag, the sound source direction θ calculated in the sound source direction estimation processing is outputted to the signal combination component 31L (S707). If there is no speech flag, though, information indicating no speech is outputted to the signal combination component 31L (S709). This concludes the processing in the sound source direction estimator 30L.

Figure 8:
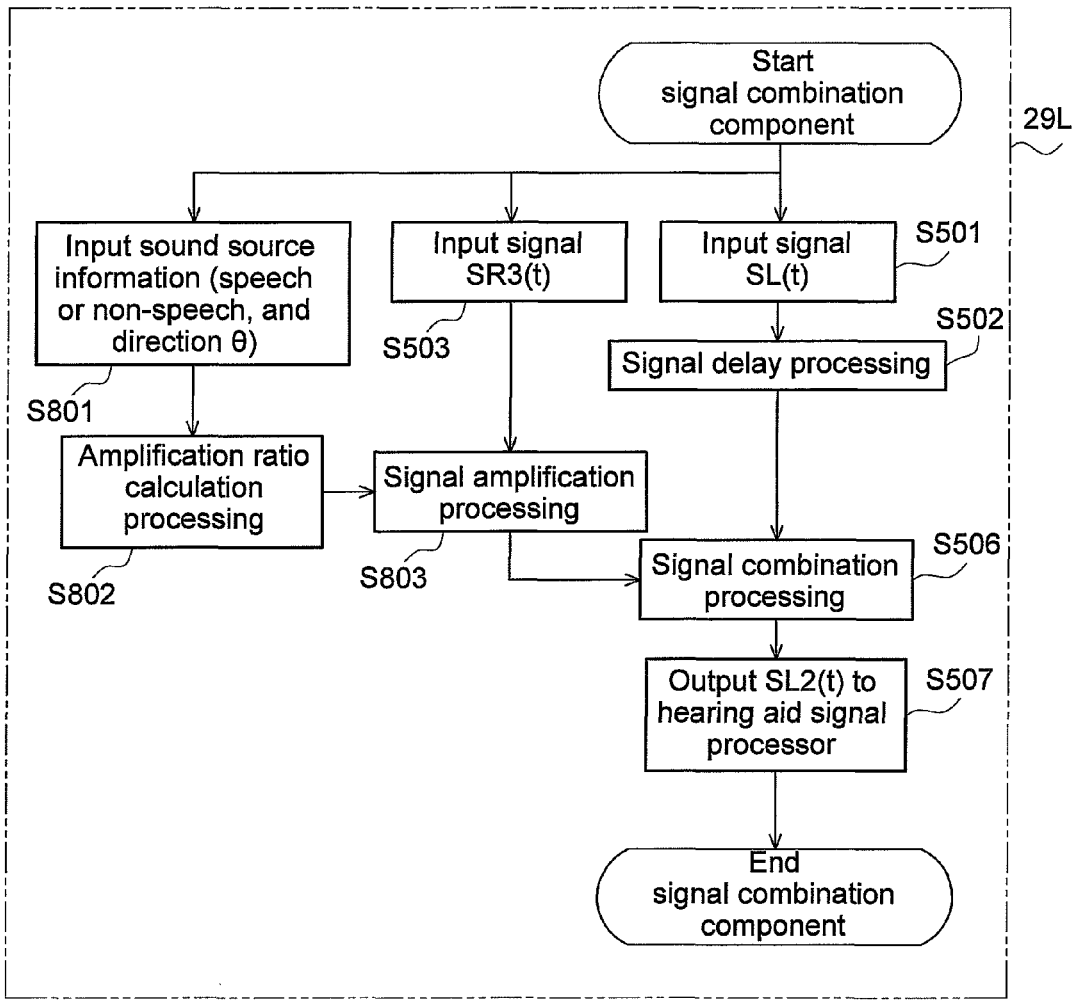
FIG. 8 is a flowchart of the signal combination component of the hearing aids pertaining to a third embodiment of the present invention.

Next, the flow of processing in the signal combination component 31L shown in FIG. 6 will be described through reference to FIG. 8.

First, the left ear signal SL(t) is inputted (S501), and the right ear signal SR3(*t*) is inputted. A signal delay with respect to communication processing is then added to the left ear signal SL(t) (S502). This signal delay processing can be eliminated by removing a delayed signal with the sound source direction estimator 30L.

Next, the sound source direction θ and whether or not there is a speech interval flag are inputted as sound source information (S801). Then, as amplification ratio computation processing, if the signal does not include a speech interval, the amplification ratio is set to zero, but if the signal does include a speech interval, the amplification ratio is decided from the sound source direction θ (S802).

The amplification ratio can be calculated as follows. If the sound source direction θ is on the normal hearing side, the amplification ratio is set to zero, but if the sound source direction θ is on the impaired hearing side, the amplification ratio is calculated on the basis of the sound source direction θ.

The amplification ratio can be calculated from the sound source direction θ in many different ways. To give one example, if we let the wearer's forward-facing direction be θ=0 when the wearer's head is viewed from the top, and assume that the angle by which the head is turned to the impaired hearing side is zero degrees, there is a formula in which the amplification ratio=$\alpha|\sin(\theta)|$. Consequently, the amplification ratio can be maximized when the sound source is in the directly lateral direction on the impaired hearing side. Here, α is a coefficient for adjusting the amplification ratio.

The signal on the left ear side and the signal on the right ear side that have been amplified according to the sound source direction θ and whether or not there is a speech interval are then combined (S506). The processing performed by the hearing aid signal processor 27 is the same as discussed above for FIG. 5, and so will not be described again. This concludes processing in the signal combination component.

In the above description, the hearing aid signal processor 27, the signal combination component 31L, and the sound source direction estimator 30L were described as separate constituent elements, but the hearing aid signal processor 27 may include a signal combination component and a sound source direction estimator.

If there is a hearing level difference between the left and right ears, as described for FIG. 5, it is possible to combine processing in which the amplification ratios of signals on the right ear side and the left ear side are varied according to the hearing level difference between the left and right ears. This provides hearing aids that are suited to the hearing level.

Embodiment 4

Figure 9:
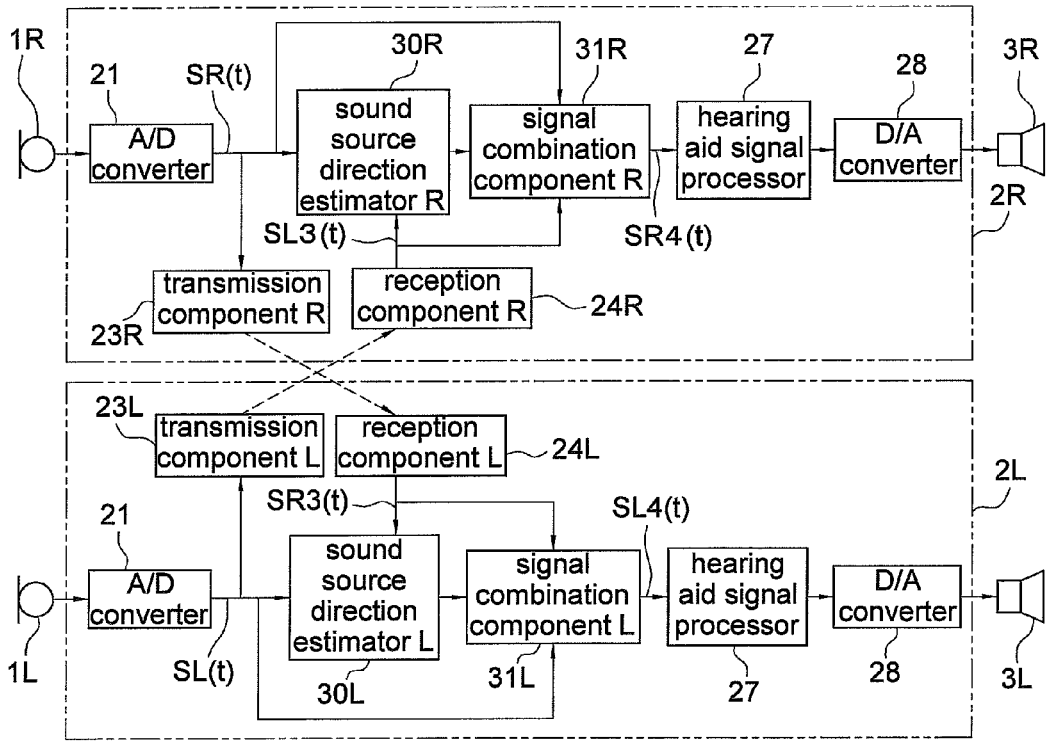
FIG. 9 is a diagram of the hearing aids pertaining to a fourth embodiment of the present invention.

FIG. 9 is a diagram of the hearing aids pertaining to a fourth embodiment of the present invention.

FIG. 9 is similar to FIG. 6 in that it is an example of application to patients with unilateral hearing loss and deafness in which there is a hearing level difference between the left and right ears. In particular, FIG. 9 is an example of a configuration applied to a patient whose hearing level is diminished on both the normal hearing side and the impaired hearing side, and who is preferred to be worn hearing aids on both the normal hearing side and the impaired hearing side.

First, the differences between FIGS. 9 and 6 will be described.

The constitution in FIG. 6 is suited to a patient with unilateral hearing loss, so that there is no need to wear a hearing aid on the normal hearing side. However, if a hearing aid needs to be worn on the normal hearing side as well, there is a method in which microphones are worn on both the left and right, the input signal on the right ear side and the input signal on the left ear side are combined, and an output sound is reproduced at the normal hearing side. In view of this, the constitution in FIG. 9 comprises microphones 1L and 1R on both the right ear side and the left ear side. Those parts that are the same in FIGS. 9 and 6 will not be described again here.

Furthermore, with the constitution in FIG. 9, sound source direction estimators 30L and 30R and signal combination components 31L and 31R are provided separately on the right ear side and the left ear side. However, this portion can also have a constitution such that signal processing is performed all at once by an apparatus that remotely controls the hearing aids (such as a remote control device).

Embodiment 5

Figure 10:
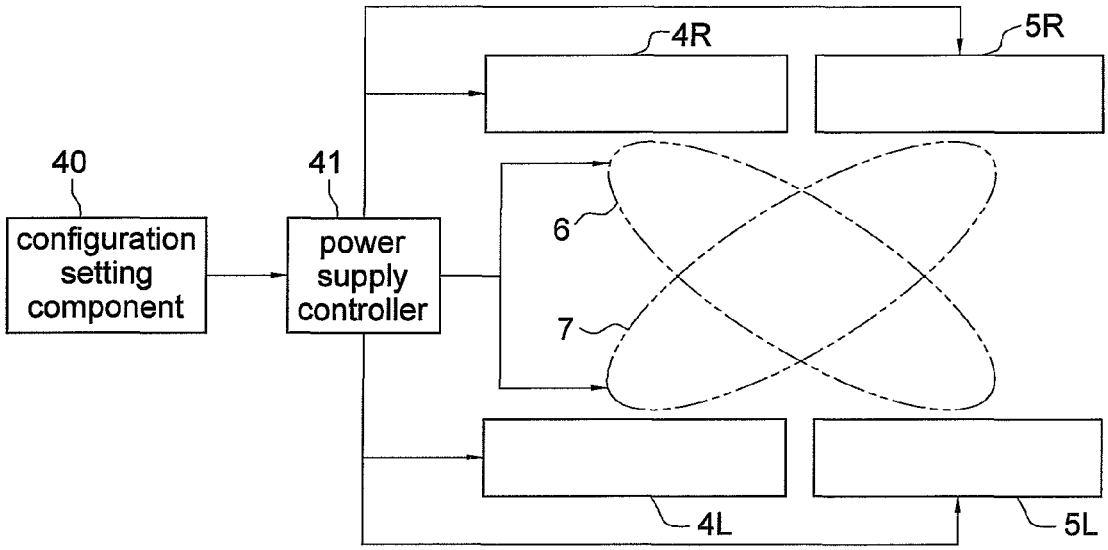
FIG. 10 is a diagram of the hearing aids pertaining to a fifth embodiment of the present invention.

FIG. 10 is a diagram of the hearing aids pertaining to a fifth embodiment of the present invention.

Figure 11:
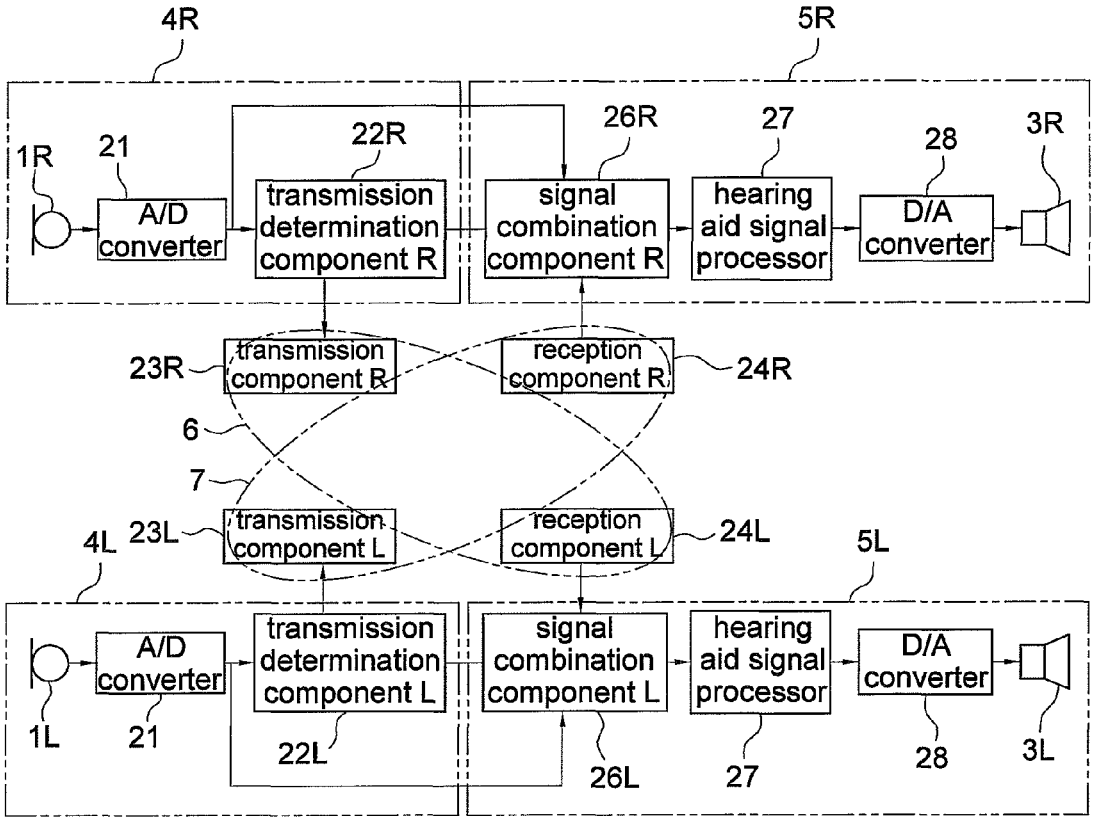
FIG. 11 is a diagram of the constituent elements of the hearing aids pertaining to the fifth embodiment of the present invention.

Before describing FIG. 10, we will describe FIG. 11 in order to describe the various constituent elements included in the hearing aids of this embodiment.

The constituent elements in FIG. 11 are the same as those in FIG. 4, but the constituent elements in FIG. 4 are divided into six portions and grouped. The six portions in FIG. 11 are a right ear pick-up 4R, a left ear pick-up 4L, a right ear output sound component 5R, a left ear output sound component 5L, a communication component 6 from the right ear side to the left ear side, and a communication component 7 from the left ear side to the right ear side.

The object of the hearing aids in Embodiment 5 is to keep the constituent elements the same as in FIG. 4, and the ideal constitution for unilateral hearing loss is realized by controlling whether the constituent elements are operational or non-operational through power supply control, rather than changing the constituent elements.

This makes it possible to deal with changes in a patient's hearing level over the years, and to afford the optimal constituent elements. Also, setting any constituent elements that are not needed by a patient to non-operational status is an effective way to cut down on power consumption.

Next, the flow of processing in the hearing aids of this embodiment will be described through reference to FIG. 10.

A configuration setting component 40 in FIG. 10 sets the above-mentioned six parts to operational or non-operational, and during initialization of the hearing aids, these settings are read into the hearing aids. The configuration setting component 40 here may be included in part of the hearing aids filtering software, or may be included in part of the software of a remote control device of the hearing aids.

Next, a power supply controller 41 performs power supply control for the purpose of reading in the operational/non-operational settings of the various parts at the configuration setting component 40, and controlling whether these six parts are operational or non-operational. The example given here was of performing power supply control for the sake of reducing power consumption, but this is not the only possibility. For instance, with a signal processor, it is also conceivable that a pass-through setting will be used instead of a non-operational setting.

FIG. 12 is an example of setting the various parts to either operational or non-operational with the configuration setting component 40.

In FIG. 12, the settings for the six parts are given in the form of a table divided in the row direction. More specifically, the parts are listed from left to right as the right ear pick-up 4R, the communication component 6 from the right ear side to the left ear side, the left ear output sound component 5L, the left ear pick-up 4L, the communication component 7 from the left ear side to the right ear side, and the right ear output sound component 5R.

Meanwhile, in FIG. 12, the settings for the six types of configuration setting are given in the form of a table divided in the column direction. More specifically, the types are listed from top to bottom as configuration setting A-1, configuration setting A-2, configuration setting B-1, configuration setting B-2, configuration setting C, and configuration setting D. The symbol "○" indicates an operational setting at the configuration setting component 40 in the table, and the symbol "x" indicates a non-operational setting at the configuration setting component 40.

In FIG. 12, if unilateral hearing loss is assumed, and if the right ear is the impaired hearing side and the left ear the normal hearing side, with the hearing level being relatively good on the normal hearing side, the configuration setting A-1 is preferable. The reason is that the hearing aids of the above-mentioned Embodiment 1 can be applied by sending sounds that are hard to hear on the impaired hearing side to the normal hearing side. The configuration setting A-2 is preferable if the right ear is the normal hearing side and the left ear is the impaired hearing side, with the hearing level being relatively good on the normal hearing side.

Next, if we assume a patient with whom there is a hearing level difference between the left and right ears, the configuration setting B-1 if preferable is the right ear is the impaired hearing side and the left ear the normal hearing side, and the hearing level on the normal hearing side makes it preferable to wear a hearing aid. The reason is that the hearing aids of the above-mentioned Embodiment 2 can be applied by taking advantage of input sound from the microphone on the normal hearing side, rather than just sending sounds that are hard to hear on the impaired hearing side to the normal hearing side.

Furthermore, the configuration setting C in FIG. 12 is useful when hearing aids are worn on both ears, but the function of linking the two ears with the hearing aids worn on both ears is not used. The configuration setting C is also a useful setting when hearing aids are worn on both ears and the ear linking function is used.

In FIG. 11, the description involved grouping the various constituent elements with respect to FIG. 4. However, the various constituent elements in FIG. 9 corresponding to Embodiment 4 may also be grouped to the above-mentioned six parts. In this case, the operational or non-operational setting can be controlled with the configuration setting component 40 and the power supply controller 41 with respect to the six parts.

INDUSTRIAL APPLICABILITY

As discussed above, the hearing aids pertaining to the present invention has a constitution in which an input signal on the impaired hearing side is subjected to a transmission determination using a specific condition, as a result of which only the desired signal is sent to the normal hearing side, and the received signal is reproduced as an output sound on the normal hearing side, so a user with unilateral hearing loss or with a hearing level difference between the left and right ears is better able to hear sounds on the impaired hearing side and the normal hearing side, and it is also easier to hear in a noisy environment.

EXPLANATION OF REFERENCE

1 microphone
1L microphone (second microphone)
1R microphone (first microphone)
2 signal processor
2L signal processor (second hearing aid)
2R signal processor (first hearing aid)
3 receiver
4R right ear pick-up

4L left ear pick-up
5R right ear output sound component
5L left ear output sound component
6 communication component from the right ear side to the left ear side
7 communication component from the left ear side to the right ear side
21 A/D converter
22 transmission determination component
23 transmission component
24 reception component
25 signal smoothing component
26 signal combination component
27 hearing aid signal processor
28 D/A converter
30 sound source direction estimator
31 signal combination component
40 configuration setting component
41 power supply controller

The invention claimed is:

1. A pair of hearing aids to be worn on a left ear and a right ear, respectively, of a hearing aids wearer, the pair of hearing aids comprising:

a first hearing aid including:

a first microphone that generates a first input signal;

a transmission determination component that decides whether or not the first input signal satisfies a specific condition; and a transmission component that transmits the first input signal when the transmission determination component has decided that the first input signal satisfies the specific condition; and a second hearing aid including:

a reception component that receives the first input signal sent from the transmission component;

a hearing aid signal processor that generates an output signal on the basis of the first input signal received by the reception component; and a receiver that reproduces an output sound on the basis of the output signal received from the hearing aid signal processor;

wherein the first hearing aid is to be worn on the hearing impaired ear with a lower hearing level out of the right and left ears of the hearing aids wearer, and the second hearing aid is to be worn on the ear with a higher hearing level out of the right and left ears of the hearing aids wearer, wherein the transmission component sends the first input signal to the reception component of the second hearing aid worn on the ear with the higher hearing level when it has been decided by the transmission determination component that the first input signal includes a speech interval.

2. The hearing aids according to claim 1, wherein the transmission component sends the first input signal to the reception component when it has been decided by the transmission determination component that the signal strength of the first input signal is less than the signal strength that can be heard at the hearing level of the hearing aids wearer.

3. The hearing aids according to claim 1, wherein the transmission component sends the first input signal to the reception component when it has been decided by the transmission determination component that the signal strength of the first input signal is less than the minimum audible value for each frequency band on the impaired hearing side of the hearing aids wearer.

4. The hearing aids according to claim 1, wherein the first input signal is divided into a plurality of segments at each of a plurality of specific times, and the hearing aid signal processor performs the same smoothing processing on the first input signal in at least two of the plurality of segments.

5. The hearing aids according to claim 1, wherein the transmission component sends the first input signal to the reception component when it has been decided by the transmission determination component that the first input signal is not within a noise interval.

6. The hearing aids according to claim 1, wherein the second hearing aid further includes a second microphone that generates a second input signal, and the hearing aid signal processor generates an output signal on the basis of a third input signal generated by combining the first input signal and the second input signal at a specific combination ratio.

7. The hearing aids according to claim 6, wherein the second input signal has a predetermined time delay.

8. The hearing aids according to claim 6, wherein the specific combination ratio is determined on the basis of the hearing level difference between the right and left ears of the hearing aids wearer.

9. The hearing aids according to claim 6, wherein at least one of the first microphone, the second microphone, and the receiver can be set to be non-operational.

10. A pair of hearing aids to be worn on a left ear and a right ear, respectively, of a hearing aids wearer, the pair of hearing aids comprising:

a first hearing aid including:

a first microphone that generates a first input signal;

a transmission determination component that decides whether or not the first input signal satisfies a specific condition; and a transmission component that transmits the first input signal when the transmission determination component has decided that the first input signal satisfies the specific condition; and a second hearing aid including:

a reception component that receives the first input signal sent from the transmission component;

a hearing aid signal processor that generates an output signal on the basis of the first input signal received by the reception component; and a receiver that reproduces an output sound on the basis of the output signal received from the hearing aid signal processor;

wherein the first hearing aid is to be worn on the hearing impaired ear with a lower hearing level out of the right and left ears of the hearing aids wearer, the second hearing aid further includes a second microphone that generates a second input signal, and the hearing aid signal processor generates a third input signal from the first input signal and the second input signal on the basis of the relation between a direction of the hearing impaired ear and a sound source direction estimated from the first input signal and the second input signal, and generates the output signal on the basis of the third input signal.

11. The hearing aids according to claim 10, wherein the hearing aid signal processor generates the third input signal by combining the first input signal and the second input signal in a ratio determined on the basis of the relation between the direction of the hearing impaired ear and the sound source direction.

12. A pair of hearing aids to be worn on a left ear and a right ear, respectively, of a hearing aids wearer, the pair of hearing aids comprising:

a first hearing aid having a first microphone that generates a first input signal from an input sound;

a second hearing aid having a receiver that reproduces an output sound on the basis of the first input signal received from the first hearing aid; and a transmission determination component that decides whether or not to send the first input signal from the first hearing aid to the second hearing aid according to whether or not the first input signal satisfies a specific condition;

wherein the first hearing aid is to be worn on the hearing impaired ear with a lower hearing level out of the right and left ears of the hearing aids wearer, and the second hearing aid is to be worn on the ear with a higher hearing level out of the right and left ears of the hearing aids wearer, wherein the first input signal is sent to the second hearing aid worn on the ear with the higher hearing level when it has been decided by the transmission determination component that the first input signal includes a speech interval.

* * * * *